US007464841B1

(12) United States Patent
Hansen et al.

(10) Patent No.: US 7,464,841 B1
(45) Date of Patent: Dec. 16, 2008

(54) GARMENT HANGER

(75) Inventors: James Hansen, Coopersville, MI (US); Russell O. Blanchard, Zeeland, MI (US)

(73) Assignee: Hangers Plus, LLC, Coopersville, MI (US)

( * ) Notice: Subject to any disclaimer, the term of this patent is extended or adjusted under 35 U.S.C. 154(b) by 0 days.

(21) Appl. No.: 11/509,836

(22) Filed: Aug. 24, 2006

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | | |
|---|---|---|---|---|---|
| 2,723,787 | A | * | 11/1955 | Bransdorf | 223/93 |
| 3,054,538 | A | * | 9/1962 | Rubin et al. | 223/88 |
| 4,123,864 | A | | 11/1978 | Batts et al. | |
| 4,198,773 | A | | 4/1980 | Batts et al. | |
| D259,087 | S | | 5/1981 | Mainetti | |
| D267,920 | S | | 2/1983 | Batts et al. | |
| D272,502 | S | | 2/1984 | Batts et al. | |
| D273,072 | S | | 3/1984 | Batts et al. | |
| D273,073 | S | | 3/1984 | Batts et al. | |
| 4,653,678 | A | | 3/1987 | Blanchard et al. | |
| 4,881,836 | A | | 11/1989 | Blanchard | |
| 4,884,727 | A | * | 12/1989 | Blanchard | 223/93 |
| 4,892,237 | A | * | 1/1990 | Duester et al. | 223/85 |
| 5,069,373 | A | | 12/1991 | Kolton et al. | |
| 5,071,045 | A | | 12/1991 | Hollis | |
| D324,313 | S | | 3/1992 | Kolton et al. | |
| D324,459 | S | | 3/1992 | Gouldson et al. | |
| D329,754 | S | | 9/1992 | Gouldson et al. | |
| D329,755 | S | | 9/1992 | Gouldson | |
| D335,581 | S | | 5/1993 | Gouldson | |
| 5,238,159 | A | * | 8/1993 | Zuckerman | 223/85 |
| D340,138 | S | | 10/1993 | Gouldson | |
| 5,305,933 | A | * | 4/1994 | Zuckerman | 223/85 |
| 5,411,189 | A | | 5/1995 | Gouldson | |
| 5,461,760 | A | | 10/1995 | Damour | |
| 5,469,995 | A | * | 11/1995 | Bredeweg et al. | 223/85 |
| 5,509,587 | A | | 4/1996 | Gouldson et al. | |
| 5,516,013 | A | | 5/1996 | Gouldson et al. | |
| 5,683,018 | A | * | 11/1997 | Sullivan et al. | 223/85 |
| 5,857,276 | A | | 1/1999 | Marshall et al. | |
| 6,196,430 | B1 | | 3/2001 | Gouldson | |
| D440,777 | S | | 4/2001 | Giustini | |

(Continued)

*Primary Examiner*—Gary L. Welch
*Assistant Examiner*—Andrew W Sutton
(74) *Attorney, Agent, or Firm*—Watson I.P. Group, PLC; Jovan N. Jovanovic; Vladan M. Vasiljevic

(57) ABSTRACT

A garment hanger comprising a body, a hook member and sizer attachment member. The body includes a central region, a first leg extending away from the central region and a second leg extending in a direction opposite to the first leg. Each of the first leg and the second leg include a strap slot which comprises a central opening defined by opposing upper flanges terminating with inward protrusions, and a convex bottom flange defining a peak corresponding to the central opening. The hook member is coupled to the body. The sizer is attached to the body proximate an interface between the hook member and the body and comprises a first and a second opposing buttress positioned about either side of a central base. Each of the first and second opposing buttresses include a plurality of flanges and a web disposed therebetween.

16 Claims, 3 Drawing Sheets

U.S. PATENT DOCUMENTS

| | | | |
|---|---|---|---|
| D441,203 | S | 5/2001 | Giustini |
| D453,423 | S | 2/2002 | Goldman et al. |
| 6,357,638 | B2 | 3/2002 | Gouldson |
| D458,039 | S | 6/2002 | Gouldson |
| D459,593 | S | 7/2002 | Gouldson |
| 6,499,633 | B1 | 12/2002 | Pogmore |
| 6,516,980 | B1 | 2/2003 | Goldman |
| 6,758,379 | B1 | 7/2004 | Elwell |
| D501,092 | S | 1/2005 | Mainetti |
| 6,883,259 | B2 | 4/2005 | Johansson |
| D507,419 | S | 7/2005 | Gouldson |
| 6,915,931 | B2 | 7/2005 | Gouldson et al. |
| D512,571 | S | 12/2005 | Gouldson et al. |
| D515,320 | S | 2/2006 | Sutton et al. |
| D515,321 | S | 2/2006 | Sutton et al. |
| D517,818 | S | 3/2006 | Sutton et al. |
| 2006/0006204 | A1 | 1/2006 | Mainetti |

* cited by examiner

GARMENT HANGER

BACKGROUND OF THE INVENTION

1. Field of the Invention

The invention relates in general to garment hangers, and more particularly, to a garment hanger having an improved strap holder and sizing system assembly. The strap holder is configured to minimize the inadvertent removal of a strap therefrom. The sizing assembly is configured for the receipt of various different sizing systems, while maintaining an aesthetic appearance where no sizing system is utilized.

2. Background Art

The use of garment hangers for shipping and displaying garments is well known in the art. Garment hangers of this type are typically employed to retain shirts, blouses, jackets, as well as a number of different garments, typically garments for the upper torso.

In many instances, these garment hangers are applied to products at the garment manufacturing or shipping facility. Garments are typically shipped on garment hangers in shipping containers from the location of manufacture (often the far east) to locations throughout the world. While such garment hangers have greatly increased in popularity, there nevertheless exist enhancements which can be made to these garment hangers to improve their usability and reliability.

Current practices utilize a sizing system wherein the size of the garment is identified on the garment hanger. Typically, a sizer having identification thereon relative to the size of the garment (i.e., a number or indicia such as S, M, L, XL, among others) is attached to the garment hanger. One such sizer system includes sizers that comprise loop structures having an opening through which the hook of the garment hanger is extended. With such systems, it is often difficult to properly retain the sizer in a desired orientation and to preclude movement of the sizer relative to the garment hanger. Additionally, a particular garment hanger is limited to use with a single type of sizer. Finally, the structures on the garment hanger itself for accepting a sizer are often aesthetically unappealing when no such sizer is present on the garment hanger.

These garment hangers are also typically suited to handling garments that have straps (often referred to as "spaghetti straps"). Generally, a slot is provided in the garment hanger with an opening providing access to the slot. The strap is typically extended through the opening and into the slot. Generally, the slots are of a elliptical configuration. One deficiency has been that, during shipment and display, the straps can easily be removed from within the slot. To address the deficiencies, certain solutions have been proposed. For example, the opening of the strap slot has been moved to one side of the elongated slot, however, typically the result is that the strap slot is vulnerable to cracking and breaking of the slot due to the large upper flange.

It is an object of the present invention to provide a garment hanger which includes an improved sizing system.

It is another object of the present invention to provide a sizing system which allows for the use of a number of different sizers in association with a single hanger.

It is another object of the invention to provide a sizing system which includes structures on the garment hanger which are aesthetically pleasing even when no sizer is present on the garment hanger.

It is another object of the invention to provide a garment hanger which includes a strap slot having a configuration which maximizes the retention of the strap slot therewithin.

These objects as well as other objects of the present invention will become apparent in light of the present specification, claims, and drawings.

SUMMARY OF THE INVENTION

The foregoing objects, as well as other objects, are achieved in a first aspect of the invention by a garment hanger comprising a body, a hook member and sizer attachment means. The body includes a central region, a first leg extending away from the central region and a second leg extending away from the central region in a direction opposite to the first leg. Each of the first leg and the second leg include a strap slot. The strap slot comprises a central opening defined by opposing upper flanges which terminate with inward protrusions, and a convex bottom flange defining a peak corresponding to the central opening. The hook member is coupled to the body. The sizer attachment means attaches the sizer to the body proximate an interface between the hook member and the body. The sizer attaching means comprises opposing first and second opposing buttresses positioned about either side of a central base. Each of the first and second opposing buttresses include a plurality of flanges and a web disposed therebetween.

In a preferred embodiment, the strap slots of each of the first leg and the second leg are substantially mirror images thereof.

In another preferred embodiment, the strap slot further includes opposing ends positioned between the respective upper flange and the convex bottom flange. The opposing ends form a curved interface with each of the respective upper flange and the convex bottom flange, to, in turn, provide a substantially elongated slot.

In another preferred embodiment, the convex bottom flange comprises a substantially symmetrical flange having the peak positioned midway between the ends thereof.

In yet another preferred embodiment, the elongated slot has a opposing teardrop configuration.

Preferably, a secondary hook is positioned at a distal end of each of the first and second legs opposite the central region.

In another preferred embodiment, each buttress of the sizer attachment means comprises a substantially triangular member having at least two flanges extending substantially perpendicular to the central base.

In one preferred embodiment, the web extends through each of the flanges substantially perpendicular thereto. In one such embodiment, the at least two flanges comprises three flanges extending substantially perpendicular to the central base.

In another preferred embodiment, the first and second buttresses are substantially identical.

In a preferred embodiment, the sizer attachment means comprises at least one of a recess and a projection on the central base which is structurally configured for matingly engaging a portion of a sizer. In one embodiment, the garment hanger further includes a sizer coupled to the sizer attachment means.

In another aspect of the invention, the invention comprises a garment hanger that includes a body, a hook member and sizer attachment means. The body includes a central region, a first leg extending away from the central region and a second leg extending away from the central region in a direction opposite to the first leg. The hook member is coupled to the body. The sizer attachment means attaches the sizer to the body proximate an interface between the hook member and the body. The sizer attaching means comprises opposing first and second buttresses positioned about either side of a central base. Each of the first and second opposing buttresses include a plurality of flanges and a web disposed therebetween.

In yet another aspect of the invention, the invention comprises a garment hanger having a body, a hook member and sizer attachment means. The body includes a central region, a first leg extending away from the central region and a second leg extending away from the central region in a direction opposite to the first leg. Each of the first leg and the second leg include a strap slot. The strap slot comprises a central opening defined by opposing upper flanges which terminate with inward protrusions, and a convex bottom flange defining a peak corresponding to the central opening. The hook member is coupled to the body.

BRIEF DESCRIPTION OF THE DRAWINGS

The invention will now be described with reference to the drawings wherein.

DETAILED DESCRIPTION OF THE INVENTION

Figure 1:
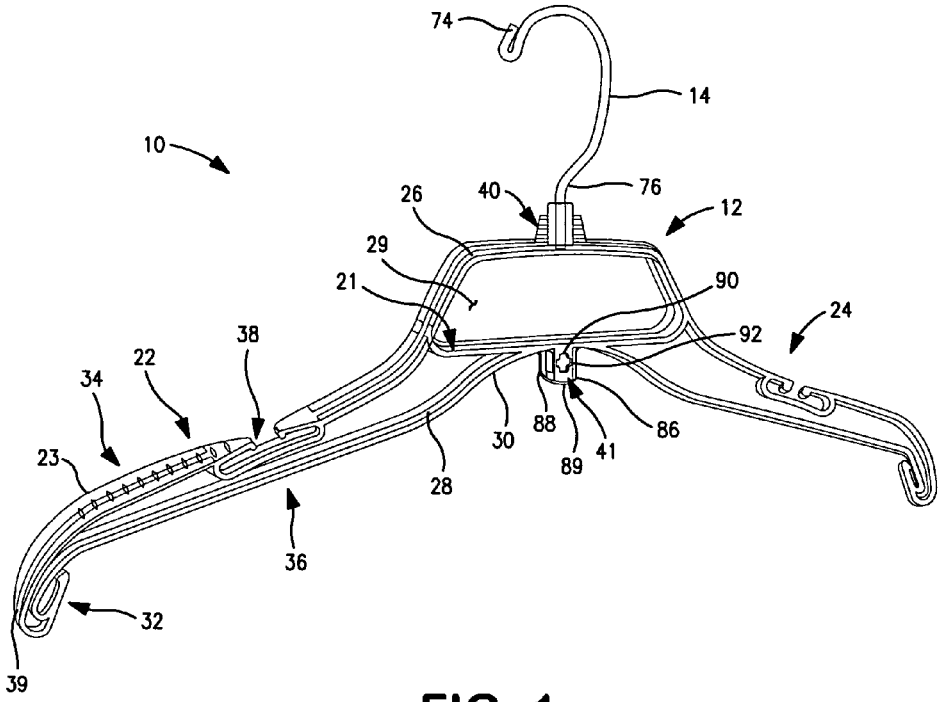
FIG. 1 of the drawings is a perspective view the garment hanger of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 5:
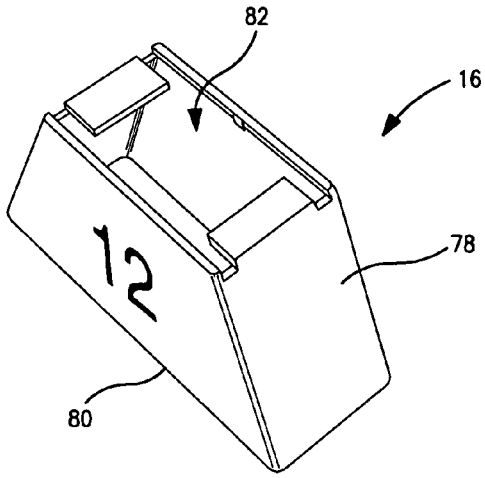
FIG. 5 of the drawings is a perspective view of the sizer of the garment hanger of the present invention.
Figure 6:
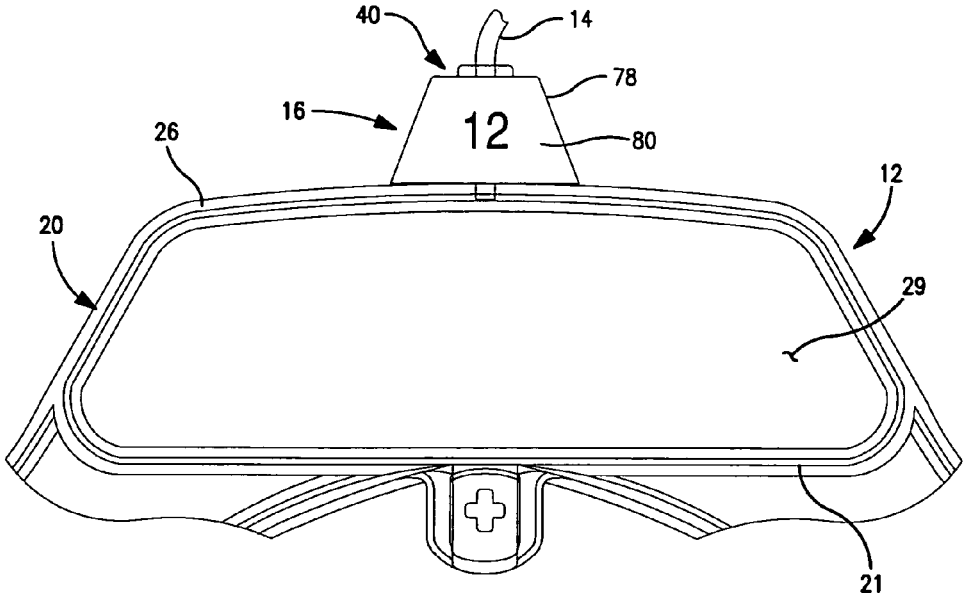
FIG. 6 of the drawings is a partial front view of the garment hanger of the present invention, showing, in particular, the sizer positioned thereupon.

Referring now to the drawings and in particular to FIG. 1, garment hanger 10 is shown in FIG. 1 as comprising body 12, hook 14, and sizer 16 (FIGS. 5 and 6). Typically body 12 is formed from a polymer resin material such as, for example, styrene-butadiene. One such material is commonly referred to as K RESIN and is manufactured by Phillips petroleum. Another material manufactured by BASF is sold under the name SYROLUX. Of course, the material is not limited to the foregoing.

Hook 14 is shown in FIG. 1 as comprising a separate member which is formed from a metal or alloy thereof. In the embodiment shown, hook 14 is a separate member which is attached to the body 12 and typically freely rotatable thereagainst. In other embodiments, the hook member may be fixed to the body. In still other embodiments, the hook member may be integrally molded with the body 12, and thereby formed from similar or identical materials.

Body 12 includes central region 20, first leg 22, second leg 24, sizer attachment assembly 40 and depending slot assembly 41. Typically, the foregoing members and assemblies are integrated into a single molded member. However, the invention is not limited thereto.

More specifically, the first leg 22 extends in a first, generally downward and outward direction from the central region. Second leg 24 extends in a second, generally downward and outward direction from the central region in a direction opposite that of the first leg. Structurally, the central region and the two leg regions comprise a generally "I" beam construction having top flange 26, bottom flange 28 and web 29 therebetween. The top and bottom flanges meet at opposing ends inasmuch as the two flanges cooperate to extend substantially about the perimeter of the body. Additional flanges, such as central region flange 21 may be included to add rigidity to the body of the garment hanger. Typically, the flanges may vary in dimension and the web may vary in thickness. Ridges, such as ridges 23 may be provided on a top flange 26 proximate the outer ends of the leg members so as to provide a resistance to the outward and downward movement of a garment.

Figure 2:
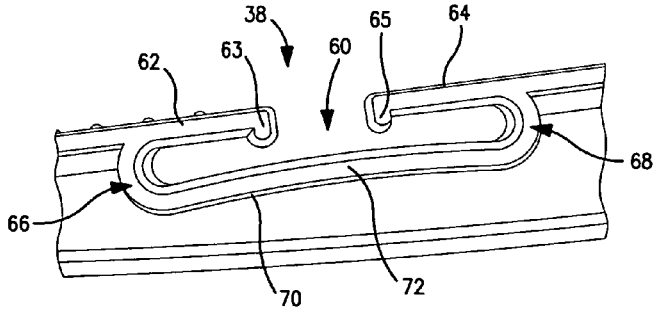
FIG. 2 of the drawings is a partial front view of the garment hanger of the present invention, showing, in particular, the strap slot of the present invention.

The first leg will be described in detail below with the understanding the second leg is substantially identical thereto. In particular, first leg 22 includes proximal end 30, distal end 32, top end 34, bottom end 36, strap slot 38, secondary hook 39. Strap slot 38 is shown in detail in FIG. 2 as comprising central opening 60, upper flanges 62, 64, opposing ends 66, 68 and convex bottom flange 70. The upper flanges 62, 64 extend from the opposing ends 66, 68, respectively and terminate with inward protrusions 63, 65, respectively proximate central opening 60. Opposing the upper flanges is convex bottom flange 70. The convex bottom flange includes peak 72 which corresponds to and is positioned across from opening 60. The strap slot, thus, takes on a shape comprising a pair of opposing substantially tear drop configurations extending outwardly from opening 60. Such a configuration substantially precludes the inadvertent removal of a strap from within the elongated slot, and the strap typically is directed to opposing end 66.

Figure 3:
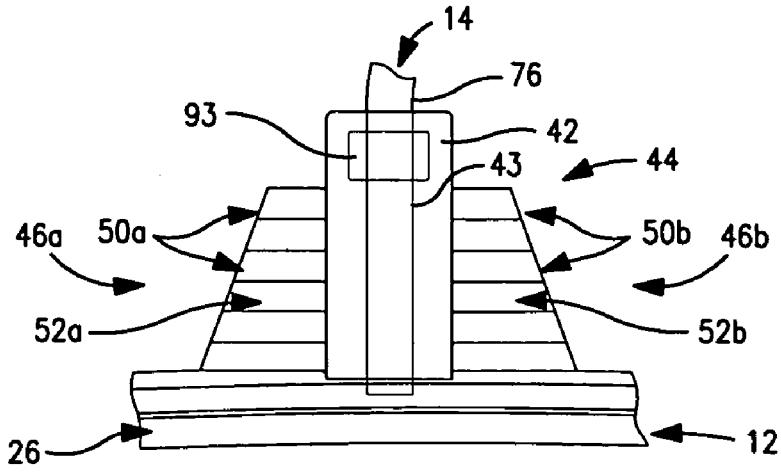
FIG. 3 of the drawings is a partial front plan view of the garment hanger of the present invention, showing, in particular, the hook boss of the present invention.
Figure 4:
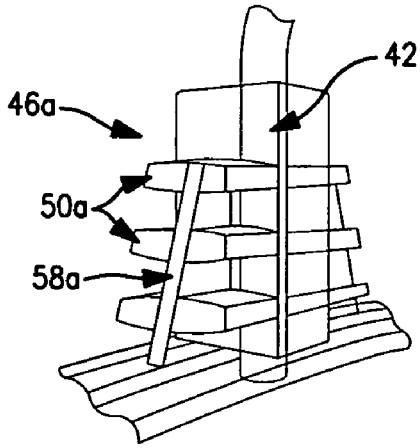
FIG. 4 of the drawings is a partial perspective view of the garment hanger of the present invention, showing, in particular, the hook boss of the present invention.

Sizer attachment assembly 40 is shown in greater detail in FIGS. 3 and 4 as comprising central base 42, hook boss 43 and means 44 for attaching a sizer. The central base 42 extends from top flange 26 of the central region 20 of body 12, and essentially forms hook boss 43. The hook boss accepts the hook therein and retains same (although the hook is allowed to rotate within the hook boss in certain embodiments). In other embodiments, the hook may be integrally molded with the central base/hook boss.

The sizer attaching means 44 comprises first opposing buttress **46*a* and second opposing buttress 46*b*. The buttresses typically form a triangular configuration utilizing the central region top flange 26 and the side surface of the central base 42. The first opposing buttress 46*a* includes a plurality of flanges such as flanges 50*a*. In the embodiment shown, three substantially parallel flanges are shown, which flanges are each successively longer and each substantially parallel to top flange 26, locally. Web 52*a* extends between the flanges substantially perpendicular to the flanges and parallel with web 29** of the body.

The second opposing buttress is substantially a mirror image of the first opposing buttress. As such, the second opposing buttress will not be described in detail herein, and it will be understood that identical reference numbers augmented with a "b" are utilized therewith.

The buttresses provide a plurality of structures with which a sizer can be mated. In particular, and as will be explained, a sizer can grasp and retain any one of a number of different features of the buttresses. Of course, the buttresses provide an aesthetic appearance even where no sizer is utilized.

The sizer attachment means may likewise comprise other structures which are associated with the central base. For example, recess 93 may be disposed on a face of the central base 42 so as to retain a corresponding structure on the sizer. In another embodiment, a different structure may be incorporated such as a tab, among others.

As is shown in FIG. 1, depending slot assembly 41 includes a front wall 86, rear wall 88 and joining wall 89 spanning between the front and rear walls. An opening 90 may be provided in the rear wall (and a similar opening may be provided in the front wall (not shown)). The front and rear walls along with the joining wall define slot 92 through which a hook of another garment hanger can be inserted. Due to the configuration of the slot (i.e., substantially perpendicular to the web of the body), a hook extending through the slot 92 is substantially parallel with the plane defined by the web 29 of body 12. Any number of configurations of the depending slot are contemplated.

Hook 14 is shown in FIG. 1 as comprising head end 74 and tail end 76. In the embodiment shown, the head end is configured with a typical radius so as to engage outside hanging surfaces. The tail end 76 is configured so as to engage the hook boss and to be retained thereby. As set forth above, the hook 14 may be a separate member or may be integrally molded with the body 12 of the garment hanger.

Sizer 16 is shown in FIGS. 5 and 6 as comprising body 78 having a plurality of sides defining outer surface 80 and inner surface 82. One such sizer is shown in U.S. Publication No. 2006/0006204 A1 published on Jan. 12, 2006, to Mario Mainetti, the entire specification of which is hereby incorporated by reference. Such a sizer includes tabs on the inside surface which interface with, for example, the sizer attachment means. In other embodiments, an interference fit or a different structure can be utilized to mate the sizer with the sizer attachment means. Another example of different sizers that can be attached to the particular sizing attachment means are shown in U.S. Pat. No. 4,123,864 issued to Batts et al, the entire specification of which is hereby incorporated by reference.

To assemble the garment hanger of the present invention, the body 12 is first provided. Once provided, the hook can be coupled to the body (where a separate hook member is provided). Specifically, tail end 76 of hook 14 is inserted into hook boss 43 and releasably retained thereby. In certain embodiments, the body is heated (i.e., softened), whereupon the tail end of the hook is inserted. The body is then cooled which results in a coupling of the two components.

Once made, the garment hanger is ready for use. Once a garment size is determined, the user can select an appropriate sizer and slide the sizer along the hook until the sizer interfaces with the sizing attachment means. In such a configuration, the sizer becomes coupled (typically releasably) to the underlying sizing attachment means.

Where the garment that is coupled to the garment hanger includes a strap, the strap is inserted within the opening of the strap slot on each of the first and second legs. Once positioned, the strap will tend to interface with the convex bottom flange wherein it is typically directed to the opposing end 66 of the strap slot. Due to the generally opposing teardrop configuration with the inward protrusions, the strap is typically precluded from inadvertent dislodgement from within the slot.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A garment hanger comprising:

a body having a central region, a first leg extending away from the central region and a second leg extending away from the central region in a direction opposite to the first leg, each of the first leg and the second leg including an elongated strap slot, at least one elongated strap slot comprising a central opening defined by substantially planar opposing upper flanges which terminate with inward protrusions directed toward a convex bottom flange, the convex bottom flange defining a peak corresponding to the central opening, between the inward protrusions, wherein the convex bottom flange is longer than the width thereof;

means for attaching a sizer to the garment hanger, the attaching means comprising a central base extending upwardly away from top flange of the central region, a first and a second opposing buttress positioned about either side of the central base and above the top flange, the buttresses defining a web that is substantially coplanar with central region of the body and substantially perpendicular to each of the central base and top flange, each of the first and second opposing buttresses including a plurality of flanges extending outwardly from the central base in a direction substantially perpendicular to the central base and the web and substantially perpendicular to the top flange;

a hook member coupled to and extending from a bore within the central base.

2. The garment hanger of claim 1 wherein the elongated strap slots of each of the first leg and the second leg are substantially mirror images thereof.

3. The garment hanger of claim 1 wherein at least one of the elongated strap slots further includes opposing ends positioned between the respective upper flange and the convex bottom flange, the opposing ends forming a curved interface with each of the respective upper flange and the convex bottom flange, to, in turn, provide the substantially elongated slot.

4. The garment hanger of claim 1 wherein the convex bottom flange comprises a substantially symmetrical flange having the peak positioned midway between the ends thereof.

5. The garment hanger of claim 1 further comprising a secondary hook positioned at a distal end of each of the first and second legs opposite the central region.

6. The garment hanger of claim 1 wherein each buttress of the sizer attachment means comprises a substantially triangular member having at least two flanges extending substantially perpendicular to the central base, and to the web defined thereby.

7. The garment hanger of claim 6 wherein the at least two flanges comprises three flanges extending substantially perpendicular to the central base.

8. The garment hanger of claim 6 wherein the first and second buttresses are substantially identical.

9. The garment hanger of claim 1 wherein the sizer attachment means comprises at least one of a recess and a projection on the central base which is structurally configured for matingly engaging a portion of a sizer.

10. The garment hanger of claim 1 further comprising a sizer coupled to the sizer attachment means.

11. A garment hanger comprising:

a body having a central region, a first leg extending away from the central region and a second leg extending away from the central region in a direction opposite to the first leg, the central region having a top flange;

means for attaching a sizer to the garment hanger, the attaching means comprising a central base extending upwardly away from top flange of the central region, a first and a second opposing buttress positioned about either side of the central base and above the top flange, the buttresses defining a web that is substantially coplanar with central region of the body and substantially perpendicular to each of the central base and top flange, each of the first and second opposing buttresses including a plurality of flanges extending outwardly from the central base in a direction substantially perpendicular to the central base and the web and substantially perpendicular to the top flange;

a hook member coupled to and extending from a bore within the central base.

12. The garment hanger of claim 11 wherein each buttress of the sizer attachment means comprises a substantially triangular member having at least two flanges extending substantially perpendicular to the central base and to the web defined thereby.

13. The garment hanger of claim 12 wherein the at least two flanges comprises three flanges extending substantially perpendicular to the central base.

14. The garment hanger of claim 12 wherein the first and second buttresses are substantially identical.

15. The garment hanger of claim 11 wherein the sizer attachment means comprises at least one of a recess and a projection on the central base which is structurally configured for matingly engaging a portion of a sizer.

16. The garment hanger of claim 11 further comprising a sizer coupled to the sizer attachment means.

* * * * *